United States Patent [19]

Tuckey

[11] Patent Number: 4,649,884

[45] Date of Patent: Mar. 17, 1987

[54] FUEL RAIL FOR INTERNAL COMBUSTION ENGINES

[75] Inventor: Charles H. Tuckey, Cass City, Mich.

[73] Assignee: Walbro Corporation, Cass City, Mich.

[21] Appl. No.: 836,539

[22] Filed: Mar. 5, 1986

[51] Int. Cl.[4] ..... F02M 55/04

[52] U.S. Cl. ..... 123/457; 123/470; 123/510; 138/26

[58] Field of Search ..... 123/457, 468, 469, 470, 123/510; 138/26, 30

[56] References Cited

U.S. PATENT DOCUMENTS 3,227,147 1/1966 Gossiaux ..... 123/468

3,536,102 10/1970 Allewitz et al. ..... 138/30

4,205,637 6/1980 Ito et al. ..... 123/457 X 4,497,388 2/1985 Dexter ..... 123/30 X

*Primary Examiner*—Tony M. Argenbright

*Attorney, Agent, or Firm*—Barnes, Kisselle, Raisch, Choate, Whittemore & Hulbert

[57] ABSTRACT

A fuel rail for internal combustion engines utilizing fuel injectors which includes an elongate housing having an internal chamber with a fuel inlet near one end and a fuel outlet leading to a pressure regulator valve. The chamber is divided longitudinally by a flexible metal membrane which absorbs pulsations created by the injectors and stabilizes the fuel supply to the fuel injectors.

6 Claims, 8 Drawing Figures

FUEL RAIL FOR INTERNAL COMBUSTION ENGINES

FIELD OF INVENTION

Devices for furnishing fuel to a multiple cylinder internal combustion engine with an electric pump fuel source.

BACKGROUND AND OBJECTS OF THE INVENTION

In furnishing fuel to a multiple cylinder engine utilizing a multiple point injection unit, that is, one injector at each cylinder, it is common to use a fuel manifold with a fuel inlet near one end and a fuel outlet near the other end. Fuel is furnished to the inlet from a fuel pump and is discharged to a pressure regulator which returns fuel to the tank.

It has been found that pressure pulses in the fuel manifold due to the fuel injection action have interfered with the furnishing of fuel to the respective cylinders in equal quantities. Also, these pressure pulsations created by the injectors cause a noise called "injector rap" which travels back through the fuel supply line and proves to be objectionable to passengers in a vehicle.

It is an object of this invention to provide a fuel rail which will materially reduce the undesirable pulsations in the fuel available to the individual fuel injectors and smooth out the fuel flow to make it available at each injector in suitable quantity and at a proper pressure to insure the maximum efficiency of the fuel supply system, as well as reduce noise in the vehicle.

Other objects and features of the invention will be apparent in the following description, accompanying drawings, and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
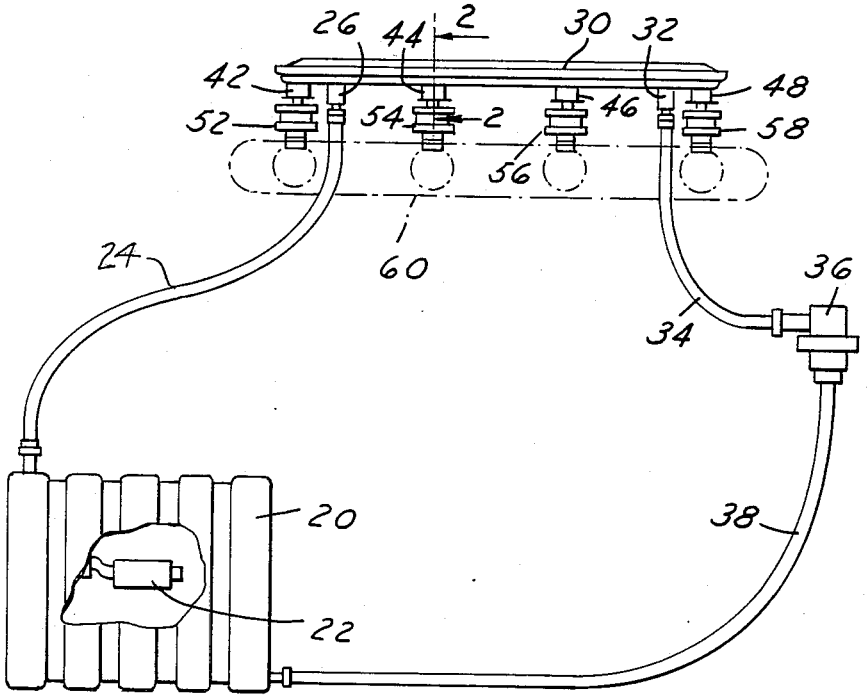
FIG. 1, a diagrammatic depiction of the fuel system including the fuel rail.

WITH REFERENCE TO THE DRAWINGS, in FIG. 1, a fuel tank 20 of standard construction is illustrated having an intank pump 22 of a type illustrated in my U.S. Pat. No. 4,540,354 issued Sept. 10, 1985. A fuel line 24 carries fuel from the pump 22 to a fuel inlet collar 26 at one end of a fuel rail 30. A fuel outlet collar 32 at the other end of the fuel rail is connected to a fuel by-pass line 34 leading to a pressure regulator 36 which dumps into return line 38 leading to the fuel tank 20.

The fuel rail 30 has four fuel injector connecting collars 42, 44, 46 and 48 which carry fuel injectors 52, 54, 56 and 58, each associated with the engine manifold 60. These fuel injectors are of standard construction operated electronically utilizing, for example, solenoid actuated valves.

Each fuel injector is located adjacent the intake valve of a cylinder so that it feeds directly into the engine fuel manifold at the proper location. The fuel rail 30 is actually connected to the engine manifold by the fuel injectors, but it is also supported on the engine by suitable brackets (not shown) to eliminate mechanical vibration.

Figure 2:
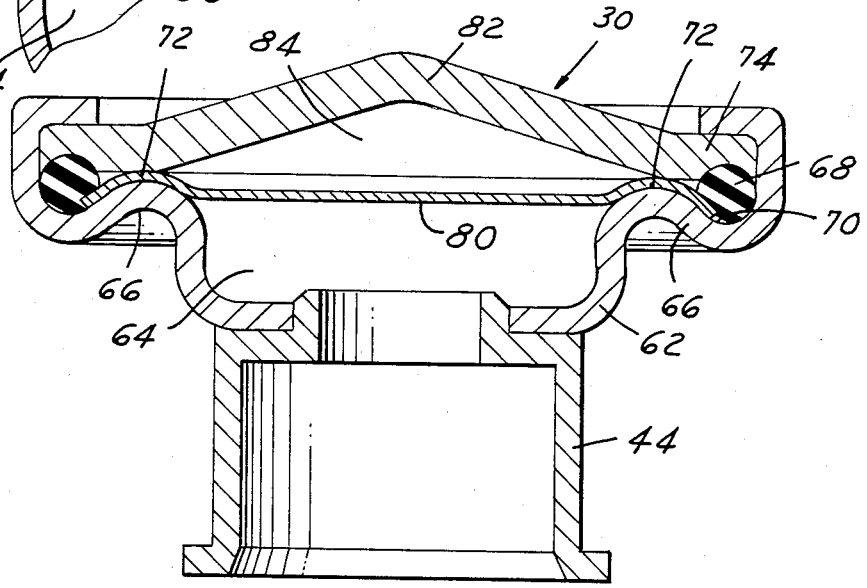
FIG. 2, a sectional view on line 2—2 of FIG. 1.
Figure 3:
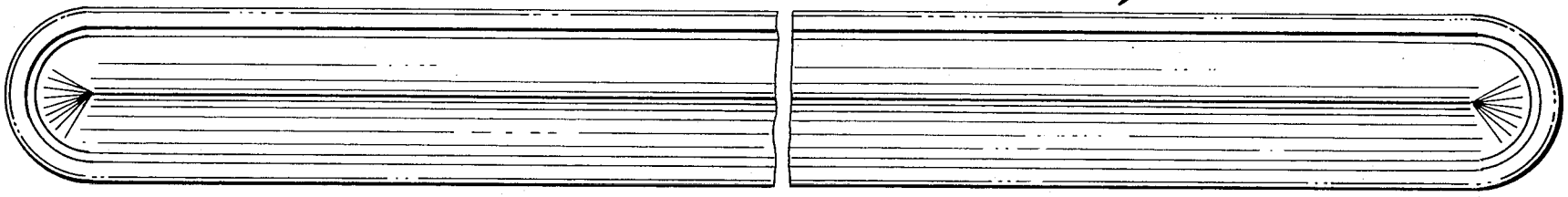
FIG. 3, a plan view of a fuel rail.
Figure 4:
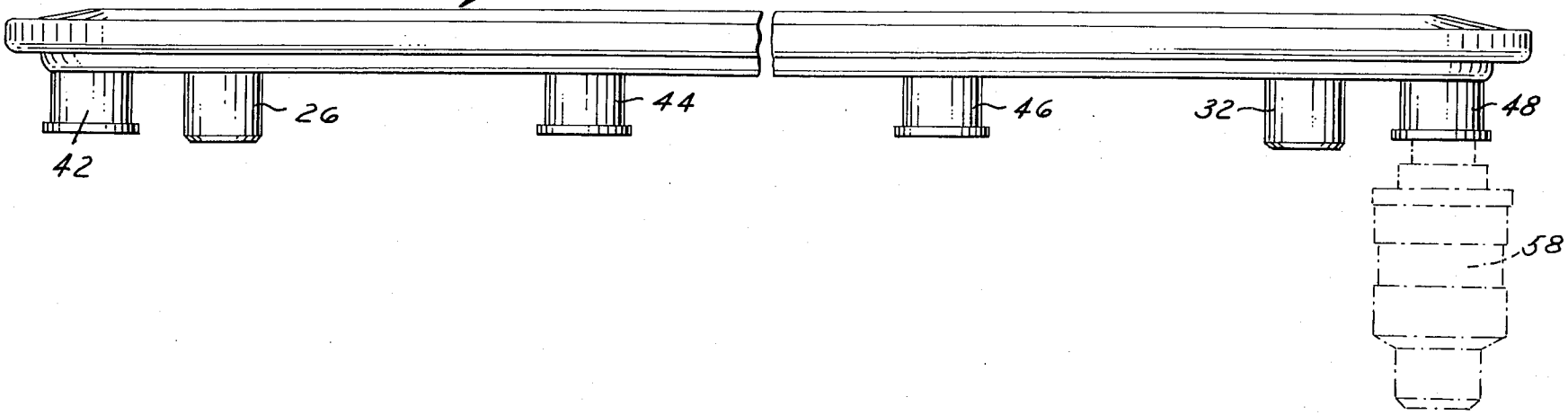
FIG. 4, a side elevation of an enlarged view of a fuel rail.

A sectional view in FIG. 2 illustrates the construction for the fuel rail 30. An elongate body 62 forms an elongate channel 64 with continuous flanges 66 which carry an oval O-ring 68 in a formed groove 70.

A diaphragm 80 overlies the channel 64 with a continuous peripheral edge 72 extending over a portion of the continuous flange 66. This diaphragm is preferably formed of a thin stainless steel having a thickness of about 0.010". The result is an elongate chamber 64 on the fuel-side (wet side) of the diaphragm.

A domed cover element 82 has a peripheral edge 74 which overlies the edge 72 of the diaphragm. The flange 66 is formed over the cover and the diaphragm under pressure to seal the parts together in conjunction with the O-ring 68. This leaves an elongate sealed pressure chamber 84 above the diaphragm. If by some chance the diaphragm should rupture, the sealed chamber 84 would contain the fuel.

Figure 5:
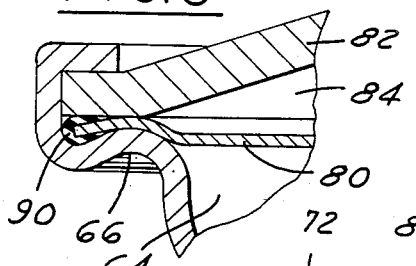
FIG. 5, a sectional view of a modified diaphragm seal.

In a modified construction, illustrated in FIG. 5, the edges of the diaphragm 80 are coated around with a stable sealant material 90 which in assembly is compressed between flanges of the body 62 and the cover 82 to form a seal. The material 90 is a synthetic rubber or plastic which is inert to hydrocarbon fuels.

IN THE OPERATION, fuel is furnished from the pump 22 to the chamber 64 where it flows the length of the chamber and reaches each of the fuel injector ports. The pressure regulator 36 in the outlet line 34 maintains a reasonably steady fuel pressure in the chamber 64. The pulses in the chamber resulting from the pump surges and the residual injector reaction are absorbed to a significant degree by the flexing of the elongate diaphragm 80 so that there is a steady pressure in the chamber, and the objectable "injector rap" noise is avoided.

It has been found that the pulse magnitude has been reduced by a factor of 10 in actual testing.

Figures 6, 7, 8:
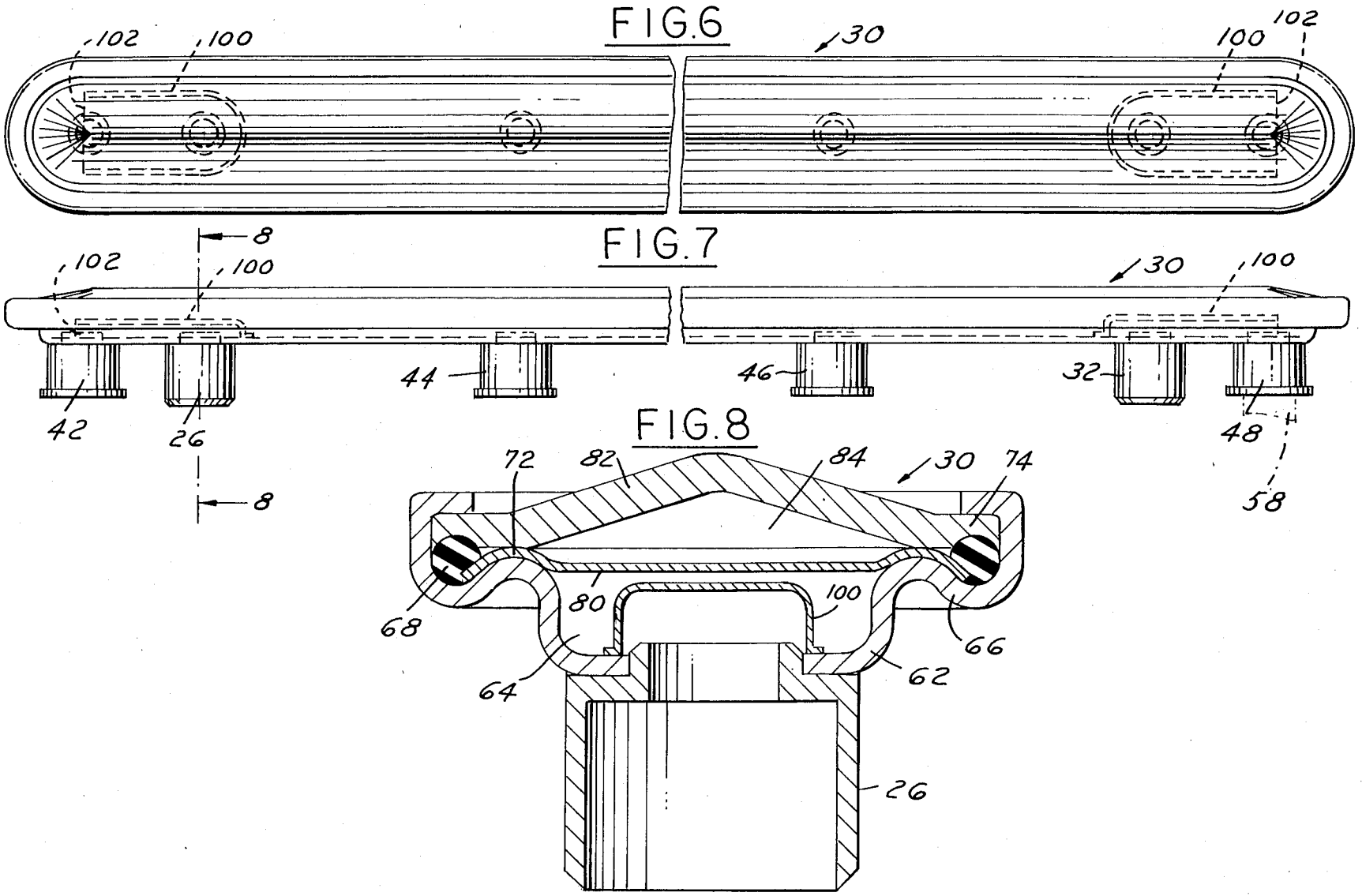
FIG. 6, a plan view of a modified fuel rail.
FIG. 7, a side view of the modified rail shown in FIG. 6.
FIG. 8, a sectional view on line 8—8 of FIG. 6.

In FIGS. 6 and 7, a modified fuel rail is illustrated in which in the chamber 64 a flow shield 100 is provided at each end overlying the respective inlet and outlet collars 26 and 32. These shields are open at the extreme ends as at 102. The shields serve to move the incoming fuel to the full length of the rail to insure that the end injector ports are not starved of fuel.

What I claim is:

1. A fuel rail for internal combustion engines for use with fuel injection units mounted on a fuel manifold of an engine which comprises:

(a) an elongate housing having an elongate hollow chamber with a mounting side and a closed side, said mounting side having a fuel inlet adjacent one end and a fuel outlet adjacent the other end, and a plurality of ports spaced between said ends, (b) a fuel injector connected to each of said ports to receive fuel from said chamber, (c) a fuel source to furnish liquid fuel under pressure to said chamber through said inlet, (d) a pressure regulator connected to said fuel outlet to regulate fuel pressure in said chamber, and (e) a flexible diaphragm in said chamber dividing said chamber longitudinally and transversely into a fuel-side chamber exposed to said inlet and outlet and a dry-side chamber exposed to the closed side of said housing.

2. A fuel rail as defined in claim 1 in which said fuel rail is formed of a base housing to be connected to said fuel injector, a closure housing to overlie said base housing, and means to join said housings peripherally in sealed relation.

3. A fuel rail as defined in claim 2 in which said means to join said housings comprises a flange on said base housing peripherally overlying the said closure housing, and means between said flange and said cover to seal the periphery of said housings.

4. A fuel rail as defined in claim 3 in which said means to seal said housings comprises a border of compressible sealant material on the periphery of said diaphragm.

5. A fuel rail as defined in claim 1 in which flow shields are provided within said fuel-side chamber at said fuel inlet and fuel outlet, each respectively in communication with said inlet and outlet and having openings facing the respective ends of said fuel side chamber to achieve flow of fuel to each end of said fuel side chamber.

6. A fuel rail as defined in claim 5 in which said fuel injector ports are located respectively adjacent each end of said housing and at equal spacings between said ends, said inlet end outlet being respectively positioned spaced inwardly from said end ports whereby said shields direct fuel to said end ports.

* * * * *